US008435006B2

(12) United States Patent
Fulayter et al.

(10) Patent No.: US 8,435,006 B2
(45) Date of Patent: May 7, 2013

(54) FAN

(75) Inventors: Roy David Fulayter, Avon, IN (US); James Ong, Carmel, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 646 days.

(21) Appl. No.: 12/570,612

(22) Filed: Sep. 30, 2009

(65) Prior Publication Data

US 2011/0076148 A1 Mar. 31, 2011

(51) Int. Cl.
*F01D 5/00* (2006.01)

(52) U.S. Cl.
USPC ..... 416/193 A; 416/245 R

(58) Field of Classification Search ..... 416/193 A, 416/219 R, 220 R, 244 R, 245 R, 234, 239
See application file for complete search history.

(56) References Cited

U.S. PATENT DOCUMENTS 1,639,247 A 8/1927 Zoelly et al.
1,970,435 A 8/1934 Sharp
2,292,072 A 8/1942 Hanna et al.
2,614,638 A * 10/1952 Beaupre ..... 416/245 R
2,823,895 A 2/1958 Floroff
2,916,258 A 12/1959 Klint
2,934,259 A 4/1960 Hausmann
2,948,506 A 8/1960 Glasser et al.
3,347,520 A 10/1967 Owczarek
3,644,058 A 2/1972 Barnabei et al.
3,709,631 A 1/1973 Karstensen et al.
3,751,183 A 8/1973 Nichols et al.
4,019,833 A 4/1977 Gale
4,097,192 A 6/1978 Kulina
4,177,011 A * 12/1979 Eskesen et al. ..... 416/191
4,182,598 A 1/1980 Nelson
4,279,572 A 7/1981 Auriemma
4,349,318 A 9/1982 Libertini et al.
4,405,285 A 9/1983 Surdi
4,470,756 A * 9/1984 Rigo et al. ..... 416/220 R
4,494,909 A 1/1985 Forestier
4,576,551 A * 3/1986 Olivier et al. ..... 416/191
4,872,812 A 10/1989 Hendley et al.
4,936,749 A 6/1990 Arrao et al.
4,967,550 A 11/1990 Acton et al.
5,005,353 A 4/1991 Acton et al.
5,230,603 A 7/1993 Day
5,281,096 A * 1/1994 Harris et al. ..... 416/193 A
5,286,168 A 2/1994 Smith
5,302,085 A 4/1994 Dietz et al.
5,313,786 A 5/1994 Chlus et al.
5,350,279 A 9/1994 Prentice et al.
5,478,207 A 12/1995 Stec
5,501,575 A 3/1996 Eldredge et al.

(Continued)

*Primary Examiner* — Edward Look
*Assistant Examiner* — Liam McDowell
(74) *Attorney, Agent, or Firm* — Krieg DeVault, LLP

(57) ABSTRACT

A fan is disclosed herein. The fan includes a hub portion operable to rotate about an axis. The hub portion extends along the axis between forward and aft ends. The fan also includes at least one platform operably fixed with the hub portion. The at least one platform at least partially encircles the axis. The fan also includes at least one airfoil extending from the at least one platform radially outward relative to the axis between a base and a tip. The at least one platform terminates at forward and aft circumferential edges spaced from one another along the axis. At least one of the forward and aft circumferential edges extends about the axis and along the axis.

20 Claims, 4 Drawing Sheets

U.S. PATENT DOCUMENTS 5,540,551 A 7/1996 Heinig
5,567,114 A 10/1996 Wallace
5,573,375 A 11/1996 Barcza
5,580,217 A * 12/1996 Richards et al. ..... 416/193 A
5,620,303 A 4/1997 Moffitt et al.
5,667,361 A 9/1997 Yaeger et al.
5,913,660 A 6/1999 Knott
5,988,980 A * 11/1999 Busbey et al. ..... 416/193 R
5,988,982 A 11/1999 Clauer
5,993,161 A 11/1999 Shapiro
6,042,338 A 3/2000 Brafford et al.
6,195,982 B1 3/2001 Gysling et al.
6,379,112 B1 4/2002 Montgomery
6,428,278 B1 8/2002 Montgomery et al.
6,457,942 B1 10/2002 Forrester
6,471,482 B2 10/2002 Montgomery et al.
6,524,070 B1 * 2/2003 Carter ..... 416/193 A
6,524,074 B2 2/2003 Farrar et al.
6,582,183 B2 6/2003 Eveker et al.
6,659,725 B2 12/2003 Yeo et al.
6,814,543 B2 11/2004 Barb et al.
7,082,371 B2 7/2006 Griffin et al.
7,147,437 B2 12/2006 Burdgick et al.
RE39,630 E 5/2007 Stangeland et al.
7,244,104 B2 * 7/2007 Girgis et al. ..... 416/193 A
7,252,481 B2 8/2007 Stone
7,258,529 B2 8/2007 Wagner
7,264,447 B2 9/2007 Ono et al.
7,500,299 B2 3/2009 Dupeux et al.
7,500,832 B2 3/2009 Zagar et al.
7,520,718 B2 4/2009 Engle
7,530,791 B2 5/2009 Douville et al.
7,721,526 B2 * 5/2010 Fujimura et al. ..... 60/262
2007/0217915 A1 * 9/2007 Fujimura et al. ..... 416/219 R
2007/0243067 A1 * 10/2007 Bil et al. ..... 416/193 A
2010/0329873 A1 * 12/2010 Ruba et al. ..... 416/220 R

* cited by examiner

FAN

BACKGROUND OF THE INVENTION

1. Field of the Invention

The invention relates to a fan incorporating features to stiffen the blades of the fan.

2. Description of Related Prior Art

U.S. Pat. No. 5,501,575 discloses a fan blade attachment for gas turbine engines. A sloped deep slot is formed in the rim of a disk for accepting the dovetail of a root of the fan or compressor blade allowing the removal of a single blade from the disk. A segmented retainer plate is disposed at the aft end of the blade root and bears against the blade root to react out the slope induced axial blade loads, providing a low hub-tip ratio configuration. An annular shaped seal plate is adjacent to a platform of the blade and is utilized so as to prevent recirculation of the air in the attachment at the rim of the rotor disk.

SUMMARY OF THE INVENTION

In summary, the invention is a fan. The fan includes a hub portion operable to rotate about an axis. The hub portion extends along the axis between forward and aft ends. The fan also includes at least one platform operably fixed with the hub portion. The at least one platform at least partially encircles the axis. The fan also includes at least one airfoil extending from the at least one platform radially outward relative to the axis between a base and a tip. The at least one platform terminates at forward and aft circumferential edges spaced from one another along the axis. At least one of the forward and aft circumferential edges extends about the axis and along the axis.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF EXEMPLARY EMBODIMENTS

Figure 1:
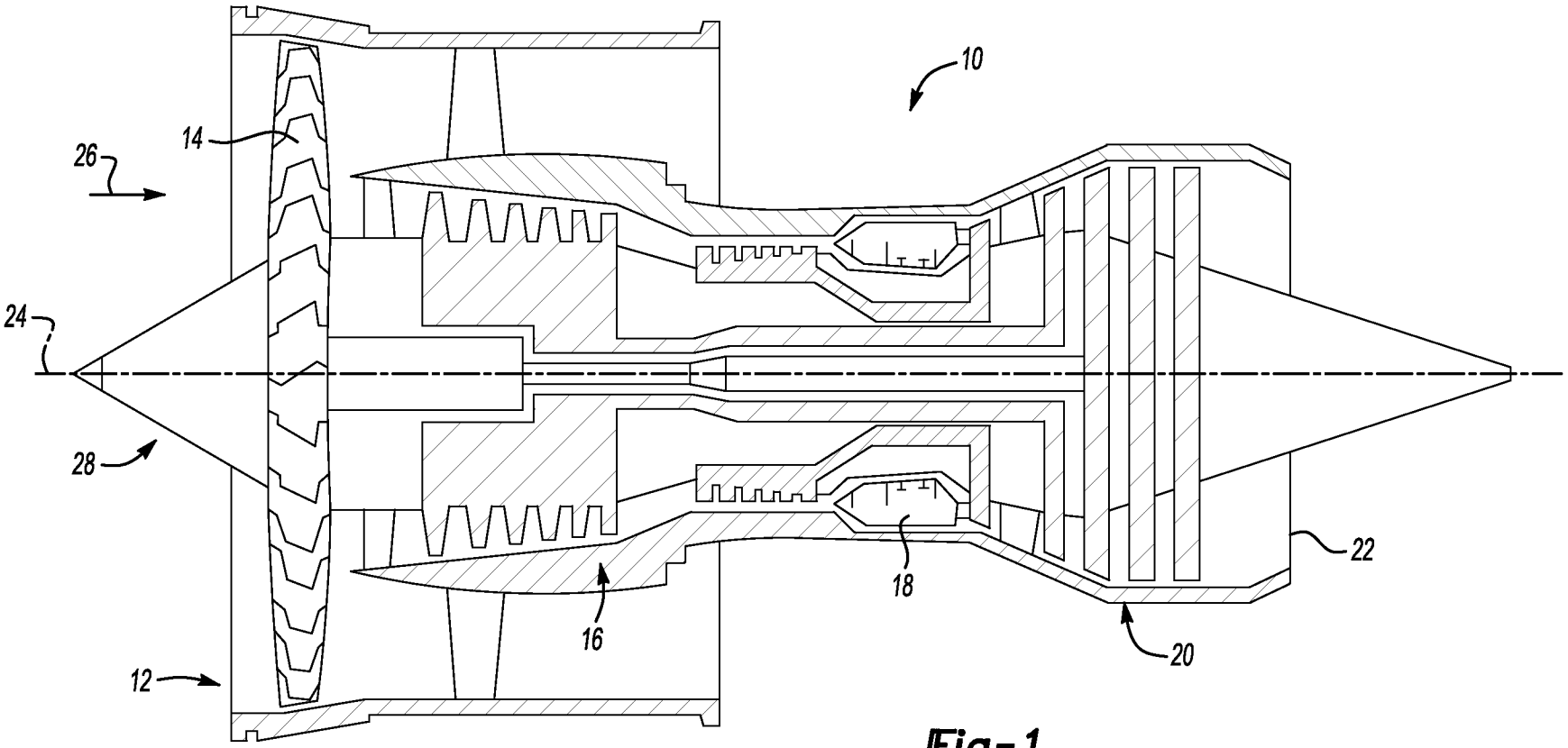
FIG. 1 is a simplified cross-section of a turbine engine according to an embodiment of the invention.

A plurality of different embodiments of the invention is shown in the Figures of the application. Similar features are shown in the various embodiments of the invention. Similar features have been numbered with a common reference numeral and have been differentiated by an alphabetic suffix. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

The invention, as exemplified in the embodiments described below, can be applied to stiffen fan blades, raising the natural frequency of the stiffened blades. Forces can be transmitted from the blades to other rotating structures along the centerline axis of the fan. These forces can be transmitted along the inner boundary of the flow path. The stiffened fan blades can yield a relatively large flutter benefit. Generally, every 5% increase in the natural frequency of the blade is estimated to be worth 1% in flutter margin. It is further estimated that the first bend frequency of the blade, which is usually the fluttering mode, could be stiffened by 20% or more giving 4% or more flutter margin to a fan design. If not needed for fan stability, this margin benefit could be traded for a lighter fan blade giving significant weight savings to a turbofan engine. The exemplary embodiment of the invention also produces a secondary benefit to blade impact by giving multiple paths for force transfer to the other structures. Typically impact forces are transferred primarily through the airfoil to the hub with secondary load paths through adjacent platforms. In the exemplary embodiments described below, the interlocking or meshing of the fan and the spinner and/or the aft fan seal plate could reduce the plastic strain in the airfoil under large bird, medium bird, hail, and ice slab ingestion. This would allow less material to be used in the airfoil and blade stalk. Additionally, since material of the spinner and/or aft fan seal plate would replace material that is typically used to define the flow path on the fan, the fan blade off loads and resulting imbalance would also be reduced allowing a lighter containment system and lighter engine frame to be designed.

While the exemplary embodiments of the invention can provide the benefits identified above, alternative embodiments of the invention can be practiced to yield similar benefits in different operating environments. However, it is noted that any benefits set forth herein may not be realized in all operating environments for all embodiments of the invention. Furthermore, it is noted that the benefits articulated herein are not exhaustive, other benefits may be perceived in the practice of one or more of the exemplary embodiments or in the practice of alternative embodiments of the invention. The benefits associated with the exemplary embodiments and described herein are not limitations of the broader invention, but rather demonstrate industrial applicability of the invention through the exemplary embodiments.

Referring to FIG. 1, a turbine engine 10 can include an inlet 12 and a fan 14. The exemplary fan 14 can be a bladed disk assembly having a disk or hub defining a plurality of slots and a plurality of fan blades, each fan blade received in one of the slots. In alternative embodiments of the invention, the fan can be a blisk wherein the hub and blades are integrally formed and unitary. The turbine engine can also include a compressor section 16, a combustor section 18, and a turbine section 20. The turbine engine 10 can also include an exhaust section 22. The fan 14, compressor section 16, and turbine section 20 are all arranged to rotate about a centerline axis 24. Fluid such as air can be drawn into the turbine engine 10 as indicated by the arrow referenced at 26. The fan 14 directs fluid to the compressor section 16 where it is compressed. The compressed fluid is mixed with fuel and ignited in the combustor section 18. Combustion gases exit the combustor section 18 and flow through the turbine section 20. Energy is extracted from the combustion gases in the turbine section 20.

A nose cone assembly 28 can be attached to the fan 14. As set forth above and shown in FIG. 2, the exemplary fan 14 can be a bladed disk assembly having a disk or hub portion 30 defining a plurality of slots. A spinner body 34 of the nose cone assembly 28 can be attached to the hub portion 30 through a front retainer 42. The fan 14 can also include a plurality of fan blades 32. Each fan blade 32 can be received in one of the slots of the hub portion 30. The blades 32 can be circumferentially spaced from one another about the axis 24 (shown in FIG. 1). Each blade 32 can include an airfoil 36 extending into the fluid flow path, a platform 38 that can be flush with the spinner body 34, and a root 40 received in the slot of the hub portion 30. The front retainer 42 can prevent forward movement of the blades 32 out of the slots. A seal plate 44 can be fixed to the hub portion 30 on the aft side of the blades 32 and prevent aft movement of the blades 32 out of the slots.

The hub portion 30 extends along the axis 24 (shown in FIG. 1) between forward and aft ends 46, 48. The platform 38 is operably fixed with the hub portion 30 and at least partially encircles the axis 24. For example, the platform 38 can be releasibly attached with the hub portion 30 such as in the exemplary embodiment of the invention wherein the platform 30 is defined by blades 32 that can be removed from the hub portion 30. In the exemplary embodiment, a plurality of platforms 38 can be positioned side-by-side about the axis 24. Alternatively, the platform 38 can be integral with hub portion 30, such as in a blisk. A radially outer surface 56 of the platform 38 can define the inner boundary of the fluid flow path.

Figure 2:
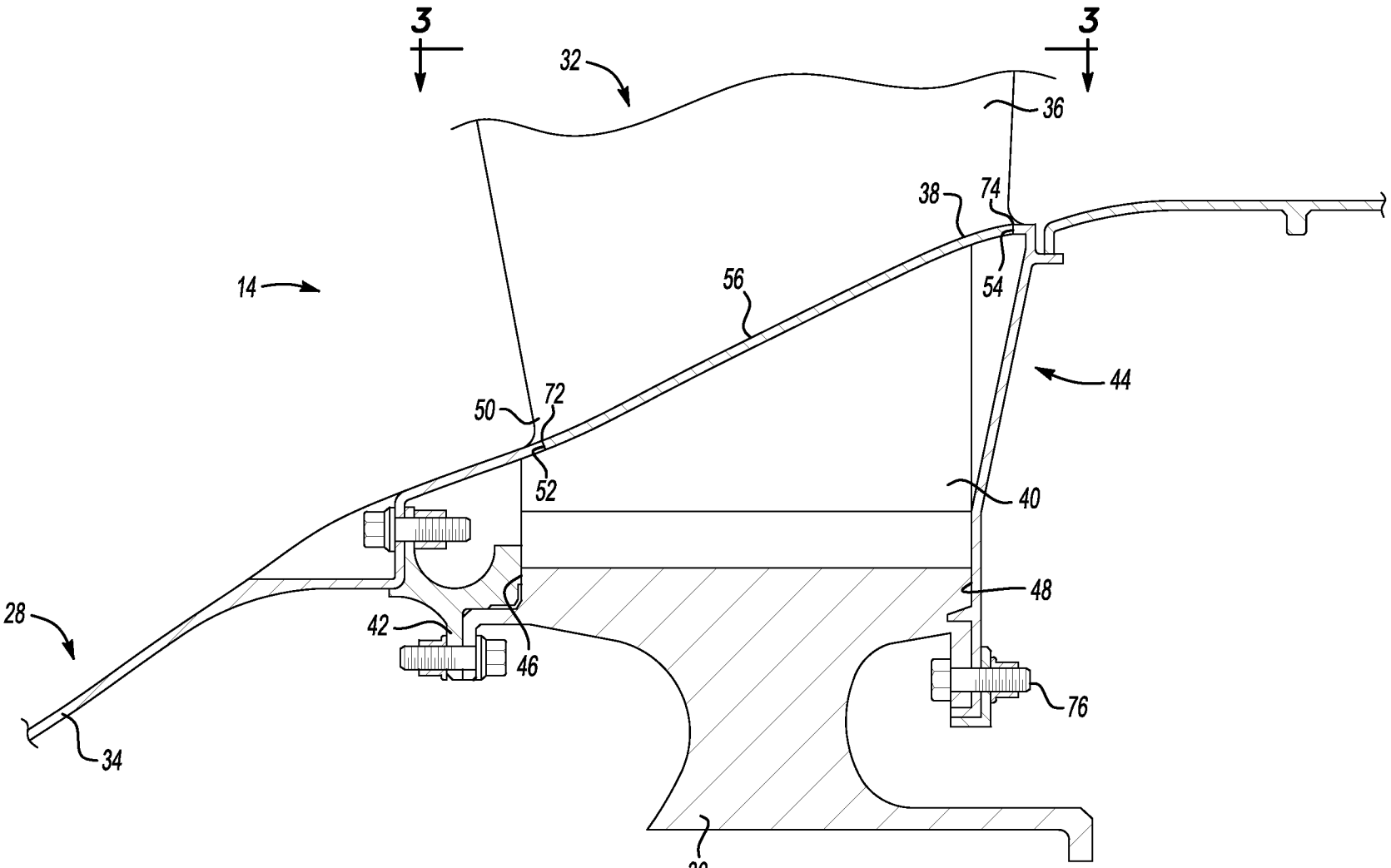
FIG. 2 is an enlarged portion of FIG. 1 shown in detail, corresponding to section lines 2-2 in FIG. 3.

The airfoil 36 extends from the platform 38 radially outward relative to the axis 24 between a base 50 and a tip (not visible in FIG. 2). The platform 38 terminates at forward and aft circumferential edges 52, 54 spaced from one another along the axis 24. At least one of the forward and aft circumferential edges 52, 54 extends about the axis 24 and along the axis 24.

Figure 3:
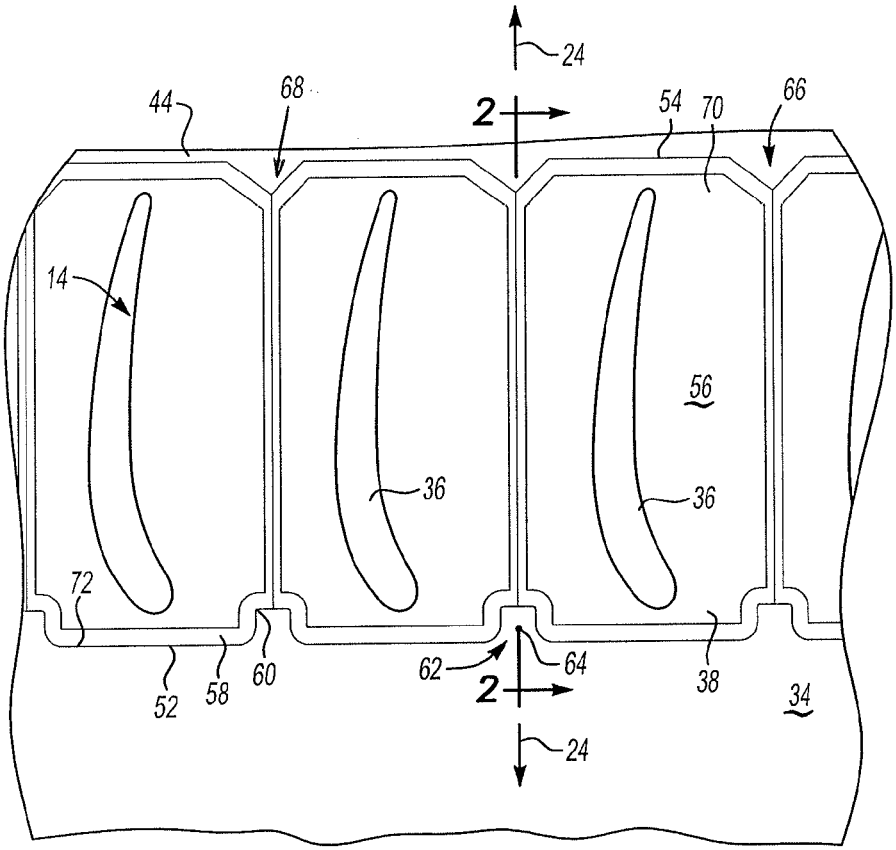
FIG. 3 is a view taken along lines 3-3 in FIG. 2.
Figure 4:
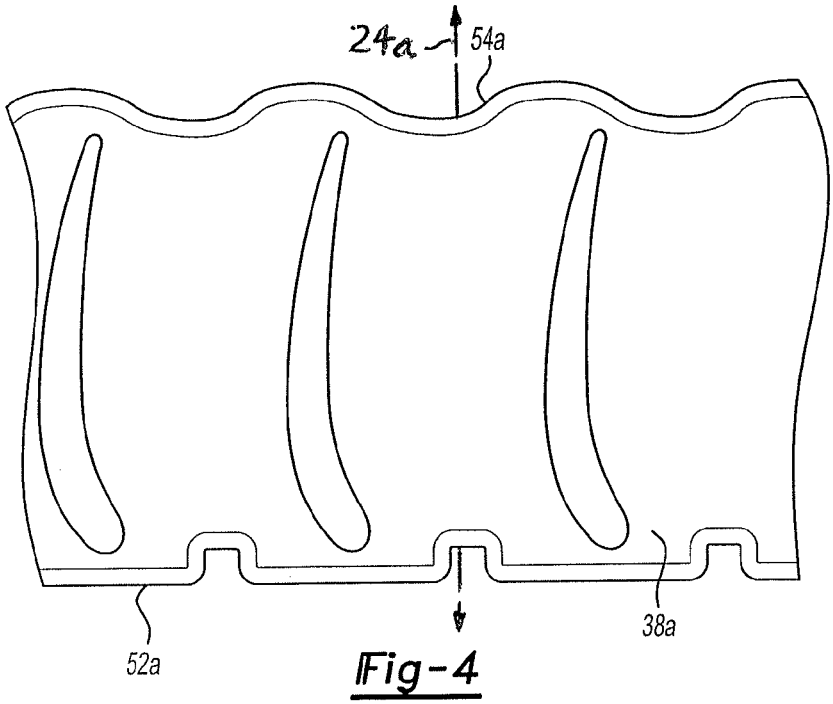
FIG. 4 is a view similar to FIG. 3 but of another embodiment of the invention.

As shown in FIG. 3, both of the edges 52, 54 extend about the axis 24 and along the axis 24. The edge 52 can extend about the axis 24 since edge 52 can follow the platform 38 and the platform 38 extends about the axis 24. The edge 52 can also extend along the axis since the position of the edge 52 along the axis can vary based on the circumferential position of the edge 52. For example, a first exemplary point 58 of the exemplary edge 52 is at first position along the axis 24 and a second exemplary point 60 of the exemplary edge 52 is at second position along the axis 24. The exemplary aft edge 54 similarly extends about and along the axis 24. It is noted that the edges 52, 54 can be defined by a single platform in a bladed disk assembly, more than one but less than all of the platforms in a bladed disk assembly, all of the platforms in a bladed disk assembly, a portion of the single platform defined by a blisk, or all of the single platform defined by a blisk. FIGS. 2 and 3 thus show the platform 38 contacting and interlocked with the spinner body 34 at the forward circumferential edge 52. FIGS. 2 and 3 also show the platform 38 contacting and interlocked with the seal plate 44 at the aft circumferential edge 54. FIG. 2 is a side, cross-sectional view and FIG. 3 is a top down view of the interconnected exemplary structures. Through the contacts among the structures, forces can be transmitted from the platform 38 to the spinner body 34 and the seal plate 44. FIG. 4 shows edges 52*a*, 54*a* defined by a single platform 38*a* of a blisk.

Referring again to FIG. 3, each individual platform 38 can define a portion of the forward and aft circumferential edges 52, 54 in the exemplary embodiment. The path followed by the exemplary edges 52, 54 can result in notches being formed in the corners of the platform 38. The notches in adjacent platforms 38 can cooperate to define a groove centered on an individual groove axis, or offset from an individual groove axis. The respective groove axes can extend perpendicular to the axis 24. For example, a groove 62 defined by the edge 52 can be square in circumferential cross-section. The circumferential cross-section can be defined in a plane substantially perpendicular to the groove axis 64. An exemplary groove 66 can be triangular in circumferential cross-section. As shown in FIG. 4, a circumferential edge 54*a* can extend along a sinusoidal path about an axis 24*a*. As used herein, the terms grooves and projections are considered analogous. For example, as shown in FIG. 3, the exemplary edge 54 can be described as defining grooves 66 and 68 and/or can be described as defining a projection 70. A circumferential edge extending along and about the axis 24 can define projections and/or grooves.

The grooves/projections defined by the edge 52 and/or the edge 54 can be circumferentially spaced from one another about the axis 24. The grooves/projections defined by edge 52 and/or edge 54 can be evenly spaced or grouped in clusters. The grooves/projections defined by edge 52 and/or edge 54 can be circumferentially spaced from the airfoils 36 about the axis 24 (as in the exemplary embodiment) or can be circumferentially aligned with the airfoils 36.

FIGS. 2 and 3 show that the fan 14 can be meshed or interlocked with at least one structure positioned adjacent to the fan 14 along the axis 24. At the forward circumferential edge 52, the fan 14 can be interlocked with the spinner body 34. The spinner body 34 can define a circumferential edge 72 that extends about the axis 24 and along the axis 24 and meshes with the forward circumferential edge 52. The edges 52 and 72 can be engaged such as the teeth of one gear mesh with those of another. The edge 72 can define a plurality of grooves/projections shaped to correspond to the shape of grooves/projections defined by the edge 52.

Similarly, at the aft edge 54, the fan 14 can be interlocked with the seal plate 44. The seal plate 44 can define a circumferential edge 74 that extends about the axis 24 and along the axis 24 and meshes with the aft circumferential edge 54. The edges 54 and 74 can be engaged such as the teeth of one gear mesh with those of another. The edge 74 can define a plurality of grooves/projections shaped to correspond to the shape of grooves/projections defined by the edge 54.

The shapes of the mating edges can be selected in view of the conditions of the operating environment. For example, if it is desired to transfer tangential/circumferential loads or axial loads, patterns of square shaped grooves and projections can be desirable. Alternatively, if it is desired to control the ratio between tangential/circumferential loads and axial loads, patterns of triangular or sinusoidal shaped grooves and projections can be desirable.

As shown in FIGS. 2 and 3, the meshing or interlocking of the fan 14 and the spinner body 34 occurs at the surface 56. Similarly, the meshing or interlocking of the fan 14 and the seal plate 44 occurs at the surface 56. The fan 14 and the spinner body 34 are also fixed together through the front retainer 42, a second location spaced radially inward of the meshed circumferential edges 52, 72. Similarly, the fan 14 and the seal plate 44 are fixed together at a second location spaced radially inward of the meshed circumferential edges 54, 74, with a bolt 76.

Figure 5:
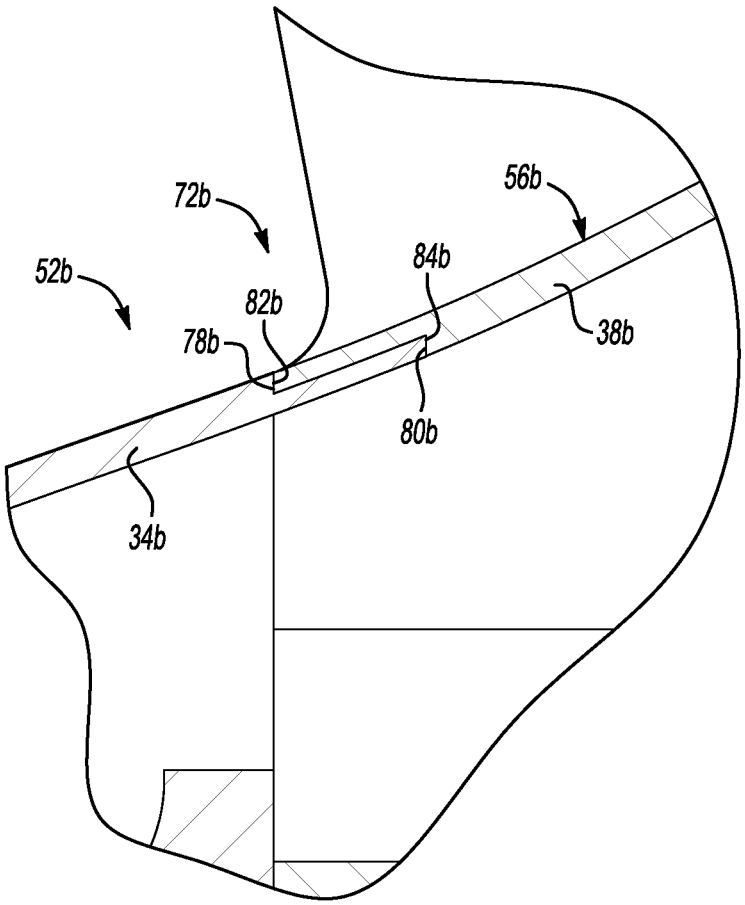
FIG. 5 is a view similar to FIG. 2 but of another embodiment of the invention.

FIGS. 2 and 3 show the edges 52 and 54, and the grooves/projections defined by the edges 52, 54, communicating with the outward surface 56. FIG. 5 shows an alternative embodiment of the invention in which the edge 52*b* of the platform 38*b* is radially bifurcated and includes a radially outer portion 78*b* and a radially inner portion 80*b*. The radially inner portion 80*b* extends about and along an axis analogous to axis 24 shown in FIGS. 1 and 3. Similarly, the edge 72*b* of the spinner body 34*b* is radially bifurcated and includes a radially outer portion 82*b* and a radially inner portion 84*b*. The radially inner portion 80*b* defines a groove receiving the radially inner portion 84*b*. Thus, the groove defined by the radially inner portion 80*b* does not communicate with the surface 56*b*.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. The right to claim elements and/or sub-combinations of the combinations disclosed herein is hereby reserved.

What is claimed is:

1. A fan comprising:

a hub portion operable to rotate about an axis and extending along said axis between forward and aft ends;

at least one platform operably fixed with said hub portion and at least partially encircling said axis;

at least one airfoil extending from said at least one platform radially outward relative to said axis between a base and a tip; and wherein said at least one platform terminates at forward and aft circumferential edges spaced from one another along said axis and wherein at least one of said forward and aft circumferential edges extends about said axis and along said axis; and wherein the at least one platform is configured to mesh and interlock with a spinner of the fan assembly and/or a seal plate of the fan assembly.

2. The fan of claim 1 wherein said at least one of said forward and aft circumferential edges is further defined as forming at least one groove centered on a groove axis extending at least substantially perpendicular to said axis.

3. The fan of claim 2 wherein said at least one groove includes a plurality of grooves circumferentially spaced from one another about said axis.

4. The fan of claim 2 wherein said at least one groove is circumferentially spaced from said at least one airfoil about said axis.

5. The fan of claim 2 wherein said at least one groove is square in circumferential cross-section.

6. The fan of claim 2 wherein said at least one groove is triangular in circumferential cross-section.

7. The fan of claim 2 wherein said platform defines a radially outward surface and said at least one groove communicates with said radially outward surface.

8. The fan of claim 1 wherein at least part of said at least one of said forward and aft circumferential edges is further defined as extending along a sinusoidal path about said axis.

9. The fan of claim 1 wherein both of said forward and aft circumferential edges extend about said axis and along said axis.

10. The fan of claim 1 wherein said hub portion and said at least one platform are integrally formed and unitary and wherein said at least one platform extends fully about said axis.

11. The fan of claim 1 wherein said at least one platform includes a plurality of platforms positioned adjacent to one another about said axis.

12. A fan assembly comprising:

a fan having:

a hub portion operable to rotate about an axis and extending along said axis between forward and aft ends;

at least one platform operably fixed with said hub portion and at least partially encircling said axis;

at least one airfoil extending from said at least one platform radially outward relative to said axis between a base and a tip; and wherein said at least one platform terminates at forward and aft circumferential edges spaced from one another along said axis and wherein at least one of said forward and aft circumferential edge extends about said axis and along said axis; and at least one structure positioned adjacent to said fan along said axis and defining a circumferential edge that extends about said axis and along said axis and meshes and interlocks with said at least one of said forward and aft circumferential edges.

13. The fan assembly of claim 12 wherein said at least one structure is further defined as a spinner body positioned on a forward side of said fan.

14. The fan assembly of claim 12 wherein said at least one structure is further defined as a seal plate positioned on an aft side of said fan.

15. The fan assembly of claim 12 wherein both of said forward and aft circumferential edges extend about said axis and along said axis and wherein said at least one structure is further defined as first and second structures positioned on opposite sides of said hub along said axis each having a circumferential edge that extends about said axis and along said axis and meshes with said at least one of said forward and aft circumferential edges.

16. The fan assembly of claim 15 where said first structure is further defined as a spinner body positioned on a forward side of said fan and said second structure is further defined as a seal plate positioned on an aft side of said fan opposite said spinner body.

17. The fan assembly of claim 12 wherein said at least one of said forward and aft circumferential edges of said fan defines a plurality of grooves and said circumferential edge of said at least one structure defines a plurality of projections operable to mate with said grooves.

18. The fan assembly of claim 12 wherein at least some of said plurality of grooves communicate with said at least one platform.

19. The fan assembly of claim 12 wherein said at least one structure and said fan are fixed together at a second location spaced radially inward of said meshed circumferential edges.

20. A method for stiffening the blades of a fan comprising the steps of:

positioning a fan having a hub portion and a plurality of blades for rotation about an axis;

positioning a first structure adjacent to the fan along the axis; and meshing and interlocking platforms of the blades of the fan and the first structure substantially at a flow path boundary defined at respective bases of the plurality of blades and extending circumferentially about the axis.

* * * * *